US009764351B2

(12) United States Patent
Kocik et al.

(10) Patent No.: US 9,764,351 B2
(45) Date of Patent: Sep. 19, 2017

(54) METHOD OF COATING A SUBSTRATE

(75) Inventors: Rainer Kocik, Bremen (DE); Peter Knepper, Ganderkesee (DE); Thomas Warda, Velen (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 1220 days.

(21) Appl. No.: 11/906,278

(22) Filed: Oct. 1, 2007

(65) Prior Publication Data

US 2008/0145555 A1 Jun. 19, 2008

Related U.S. Application Data

(60) Provisional application No. 60/848,242, filed on Sep. 29, 2006.

(51) Int. Cl.

| | |
|---|---|
| ***C23C 4/06*** | (2016.01) |
| ***B05D 1/08*** | (2006.01) |
| ***B05D 7/02*** | (2006.01) |
| ***B05D 7/00*** | (2006.01) |

(52) U.S. Cl.

CPC ..... *B05D 1/08* (2013.01); *B05D 7/02* (2013.01); *B05D 7/52* (2013.01)

(58) Field of Classification Search

CPC ..... B05D 1/08; B05D 7/52; B05D 7/02

USPC ..... 427/456; 156/289

See application file for complete search history.

(56) References Cited

U.S. PATENT DOCUMENTS

| | | | | |
|---|---|---|---|---|
| 3,666,615 | A * | 5/1972 | Iwai et al. | 428/377 |
| 4,751,113 | A * | 6/1988 | Riccio | C23C 4/02 427/405 |
| 5,273,782 | A * | 12/1993 | Sagawa et al. | 427/242 |
| 5,849,395 | A * | 12/1998 | Valentine et al. | 428/195.1 |
| 6,277,481 | B1 * | 8/2001 | Sugino et al. | 428/317.1 |
| 2002/0110694 | A1 * | 8/2002 | Falaas et al. | 428/425.8 |

FOREIGN PATENT DOCUMENTS

| | | | | |
|---|---|---|---|---|
| DE | 41 16 641 | | 11/1992 | |
| DE | 195 29 627 | | 1/1997 | |
| EP | 0 514 640 | | 11/1992 | |
| EP | 549981 | A2 * | 7/1993 | B29C 33/38 |
| EP | 1 129 787 | | 9/2001 | |
| EP | 1 746 077 | | 1/2007 | |
| JP | 03158451 | | 7/1991 | |
| JP | 2001003007 | | 1/2001 | |
| JP | 2003340512 | | 12/2003 | |

OTHER PUBLICATIONS

Merriam Webster Online Dictionary, Homogeneous, Accessed: Dec. 1, 2011, p. 1.*

* cited by examiner

*Primary Examiner* — Tabatha Penny

(74) *Attorney, Agent, or Firm* — Greer, Burns & Crain, Ltd.

(57) ABSTRACT

A method is provided for coating a substrate, in particular a fiber reinforced plastic component, a protective layer being applied, with preference by means of thermal spraying, to a non-cured resin film applied to a release film, and subsequently, after removal of the release film, the resin film being applied to the substrate and cured.

16 Claims, 2 Drawing Sheets

METHOD OF COATING A SUBSTRATE

CROSS-REFERENCE TO RELATED APPLICATIONS

This application claims the benefit of U.S. Provisional Application No. 60/848,242, filed Sep. 29, 2006, the entire disclosures of which are herein incorporated by reference.

FIELD OF THE INVENTION

The present invention relates to a method for coating a substrate, in particular a fiber reinforced plastic component, to a method for producing a coated resin film and to a fiber reinforced plastic component coated by these methods.

BACKGROUND OF THE INVENTION

Coatings are applied to various substrates for a variety of purposes. Although it can be applied to any desired substrates, the present invention and the problems on which it is based are explained in more detail with respect to carbon fiber reinforced plastic components (CRP components) in aerospace. However, the invention is not restricted to the application to carbon fiber reinforced plastic components, but can be applied to many different substrates, in particular fiber reinforced plastics.

Carbon fiber reinforced plastic components are coated for use in an aircraft, for example to provide protection from wear, corrosion protection, lightning protection, corrosion protection, protection from excessive temperature fluctuations or for heat insulating reasons. These coatings may be advantageously applied by thermal spraying. However, other methods of deposition are also conceivable. The invention therefore does not relate exclusively to coating by thermal spraying but can also be applied to other coating methods. It is possible by the method of thermal spraying to apply a wide variety of materials to substrates. For example, most metals or metal alloys allow thermal spraying, as do various ceramics and plastics.

To apply metals or their alloys by thermal spraying, for example a wire or a powder of the metal or of the alloy can be melted in an electric arc (in the case of arc spraying) or an oxygen-fuel flame (in the case of wire or powder flame spraying). Using compressed air or an inert gas, the molten particles are then accelerated at high speed onto the substrate. Another form of thermal spraying includes a plasma as the thermal energy source for (incipient) melting of the spray powder particles (in the case of plasma or high-velocity plasma spraying).

The acceleration of the particles may also take place by burning a combustible gas with oxygen in a confined volume and its expansion through a nozzle, thereby producing a high-velocity stream, into which a powder is introduced by means of a directed gas stream (in the case of high-velocity oxyfuel spraying, HVOF).

The adhesive attachment of the particles is proportional to the energy that these particles possess. The energy may be both in the form of thermal energy, that is to say in the form of heated particles, and in the form of kinetic energy, that is to say in the form of highly accelerated particles. The velocity of the particles may easily reach supersonic speed. In the case of thermal spraying, the particles have both high thermal energy and high kinetic energy. Those particles that are the first to impinge on the surface to be coated form a base for the further layers to be deposited.

One problem encountered in the coating of CRP components, however, is the poor adhesive attachment of the thermally sprayed layers on the surface of the CRP component. In order to compensate for this disadvantage, various methods have been proposed. For example, the surface of the CRP component may be roughened by means of blasting with corundum, in order to achieve better adhesive attachment of the thermally sprayed-on layer. However, this is sometimes accompanied by the fibers being exposed, and this can lead to impairment of the structural-mechanical properties of the component. In addition, if the fibers come into contact with a metallic sprayed layer, galvanic corrosion may occur if an electrolyte is present.

In the case of direct application of a coating by means of thermal spraying or else in the case of application of an adhesion-promoting intermediate layer by means of thermal spraying, the CRP component is also exposed to high thermal loading. This high thermal loading may likewise already lead to impairment of the coated CRP component during its production. Furthermore, when applying a number of layers, the substrate must be cooled between the individual application steps, making the direct coating of CRP components very time-intensive.

The applicant knows of further methods in which, for example, an intermediate layer of resin is applied directly to the CRP component before the final coating is applied to this intermediate layer. Particles intended to serve as an adhesion promoter may also be additionally mixed in with this intermediate layer of resin. Once the resin has cured, part of the intermediate layer is removed again, in order to expose embedded particles of the resin and roughen the resin. However, this method also has the disadvantage that the CRP component is still exposed to high thermal loading during the coating. Moreover, it requires further method steps.

SUMMARY OF THE INVENTION

It is therefore an object of the present invention to provide a method for coating a substrate which overcomes these problems and provides in a small number of method steps a coating on a substrate that has great adhesiveness with respect to the surface of the substrate.

This object is achieved according to the invention by a method with the features of Patent Claim 1, a method with the features of Patent Claim 11, and a component with the features of Patent Claim 12.

The present invention provides a method for coating a substrate, in particular a fiber reinforced plastic component, with the following steps: providing a non-cured resin film, applied to a release film; applying at least one protective layer to the non-cured resin film; removing the release film from the resin film to expose a bonding surface of the resin film; applying the resin film with the exposed bonding surface to the substrate to be coated; curing the resin film for the adhesive attachment of the resin film to the substrate.

The idea on which the present invention is based is that a protective layer or coating is first applied to a resin film and the latter is subsequently brought into connection with a substrate in which the resin film is cured.

The separate application of the protective layer to the resin film that is not cured provides several advantages. One is that the application of the protective layer to the resin film can be performed under conditions that could be harmful to the substrate. In particular, the resin film can be briefly exposed to higher temperatures than a substrate could withstand.

Furthermore, only a thin resin film, and not a sometimes extremely bulky, that is to say voluminous, component to be coated, has to be introduced into a coating machine. The application of the coating to the resin film and the application of the coated resin film to the substrate can be performed at different locations. Therefore, coatings for relatively large components can be prepared anywhere, without the components themselves having to be brought to the location of the extremely expensive coating devices.

At the beginning of the method, a resin film is provided on a release film or protective film. The release film is intended in this case to prevent the corresponding side of the resin film that is to be adhesively attached from adhesive attachment to arbitrary substrates. When the resin film is then to be applied to the substrate, the release film can be removed in order to expose this side of the resin film.

Subsequently, a protective layer is applied to the side of the resin film opposite from the release film. This applied coating is a protective layer for the substrate to be coated. The protective layer may be intended to provide protection from wear, corrosion protection, lightning protection, corrosion protection, protection from excessive temperature fluctuations or for heat insulating reasons.

To apply the resin film coated with the protective layer to a substrate, in particular a fiber reinforced plastic component, the release film is removed from the resin film. As a result, one side of the resin film is exposed. Since the resin film is not cured, the exposed surface of the resin film already has a certain adhesive attachment to the substrate. The resin sticks to the substrate. The surface of the resin film that was previously protected by the release film and is now exposed is applied to the substrate.

By curing the resin film, the adhesive attachment to the substrate is increased and the adhesive attachment of the protective layer is also further improved. The protective film consequently has excellent adhesive attachment to the substrate by way of the cured resin film.

The present invention also relates to a fiber reinforced plastic component, in particular for an aircraft or spacecraft, which can be produced by the method described above.

Advantageous refinements and improvements of the invention can be found in the subclaims.

In connection with the present invention, inter alia, "non-cured resin film" is to be understood as meaning a resin film that is not yet completely cured. That is to say that the resin film can still be cured further. A non-cured resin film may be a resin film that has not yet been subjected to any curing, a resin film that is partially cured or a resin film that is almost completely cured. However, the curing must not be completed before the resin film is applied to the substrate. The final curing of the resin film is only performed after application to the substrate.

According to a preferred development of the present invention, the application of the at least one protective layer is performed by means of thermal spraying. The thermal spraying allows a wide variety of materials to be applied to the resin film. Application by means of thermal spraying achieves the effect of positive anchoring of the material on the resin film. With preference, the particles of the first layer that are applied by thermal spraying penetrate easily into the soft, since not completely cured, resin film. The further layers that are applied form a close adhesive attachment to the previous layers or the resin film, so that after completion of the coating the material is positively anchored and therefore adheres well to the resin film.

According to a further preferred development, the applied material is selected from the group comprising metals, metal alloys, ceramics and plastics. In particular, carbides and/or oxides may be used as ceramics. As plastics, PEEK (polyetherether ketone) may be used for example. The metal or the metal alloy preferably comprises aluminium, zinc, nickel, copper or their alloys.

According to a further preferred development of the present invention, the resin film is a thermosetting resin film, for example of polyurethane, polyester or epoxy resin. Particularly preferred is a two-component epoxy resin. However, thermoplastic resin films can also be used.

The curing of the resin film on the substrate achieves the effect of advantageous adhesive attachment of the resin film to the substrate. During the curing of the resin film on the substrate, bonds are formed between the surface of the substrate and the resin film. These bonds are responsible for the extremely high adhesive strength of the resin film on the substrate, and consequently for the good adhesive attachment of the protective layer on the substrate.

In the case of coating a fiber reinforced plastic component, the resin film according to a further preferred development of the present invention consists of the same resin that was used for producing the plastic component. By using a similar or identical resin for the production of the plastic component and the resin film, a particularly strong adhesive attachment of the resin film on the plastic component can be ensured.

According to a further preferred development of the present invention, the curing of the resin film is performed by heating the resin film and/or irradiating the resin film over a large area or partially, i.e. over a locally limited area.

Further improved adhesive attachment of the resin film on the substrate can be achieved according to a preferred development of the present invention by the substrate being roughened before application of the resin film. In particular, the roughening of the substrate may be performed by means of a very fine emery paper. In addition, the surface may with preference be cleaned before and/or after the roughening.

The release film is intended to prevent premature adhesive attachment of the resin film on arbitrary underlying surfaces. The release film must, however, be removed before application of the resin film to the substrate surface. The adhesive attachment of the release film to the resin film should therefore only be strong enough that handling of the resin film is made possible. According to a preferred development of the present invention, the release film is a Teflon® film.

According to yet a further preferred development of the present invention, both the coated thermosetting resin film and the coated thermoplastic resin film can be stored after application of the protective layer. With preference, the thermosetting resin film is stored at a temperature of below 10° C., with greater preference at a temperature of below 0° C. and with most preference at a temperature of below −15° C. The storing of the thermosetting resin film at low temperature allows the curing of the resin film to be greatly delayed. The thermoplastic resin film is stored with preference at temperatures around room temperature, i.e. in a temperature range from 15 to 30° C., with preference from 18 to 25° C.

If the resin is a resin that is cured by means of irradiation, the resin film is stored with preference with the exclusion of light or any other irradiation. The storing of the thermosetting resin film at lower temperatures or of the thermoplastic resin film at around room temperature and with the exclusion of radiation allows the resin film to be stored over several days, weeks or months before it is applied to the substrate.

Any substrates are used as the substrate for a coating. Fiber reinforced plastics are preferred. The fibers of the fiber reinforced plastic may be produced from different materials. For example, carbon fibers, glass fibers or aramid fibers may be used. The use of carbon fibers produces a carbon fiber reinforced plastic (CRP) and the use of glass fibers produces a glass fiber reinforced plastic (GRP). However, hybrid variants of these fibers and their mixtures may also be used in fiber reinforced plastic components that are coated by means of the method described above.

BRIEF DESCRIPTION OF THE DRAWINGS

The invention is explained in more detail below on the basis of exemplary embodiments with reference to the accompanying figures, in which.

Unless otherwise specified, in the figures the same reference numerals designate components that are the same or functionally the same.

DETAILED DESCRIPTION OF THE INVENTION

Figure 1:
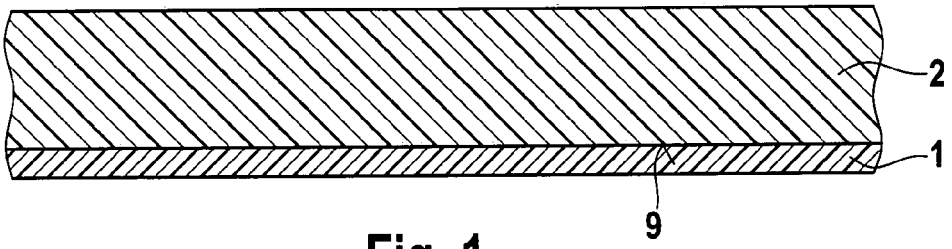
FIG. 1 shows a cross-sectional view of an arrangement with a release film and a resin applied to it.

FIG. 1 shows a cross-sectional view of a resin film 2 applied to a release film 1. The resin film 2 consists, for example, of a two-component epoxy resin. It is preferably a toughened epoxy resin that can be kept at −18° C. for 18 months and at 22° C. for 42 days.

The resin is evenly applied to the release film 1 of Teflon®, in order to form a resin film 2. The release film 1 protects a bonding surface 9 of the resin film 2 before the application of the resin film 2 to a substrate from premature and/or undesired adhesive attachment and/or from contamination of the bonding surface 9.

Figure 2:
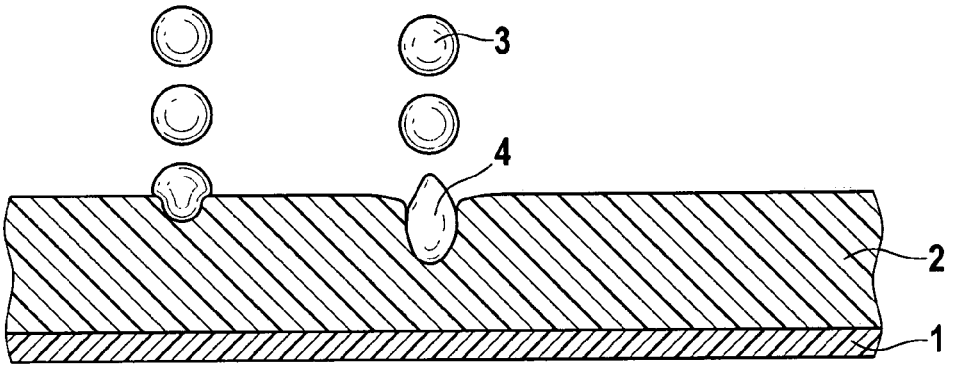
FIG. 2 shows the method step of applying coating particles to the resin film from FIG. 1 in a cross-sectional view.

In a next step, aluminium particles 3 are applied to the resin film 2 by means of thermal spraying, as represented in FIG. 2. The particles 3 thereby penetrate partially into the resin film 2 in a first method step of the thermal spraying, in order subsequently to take the form of applied and partially embedded sprayed particles 4.

Figure 3:
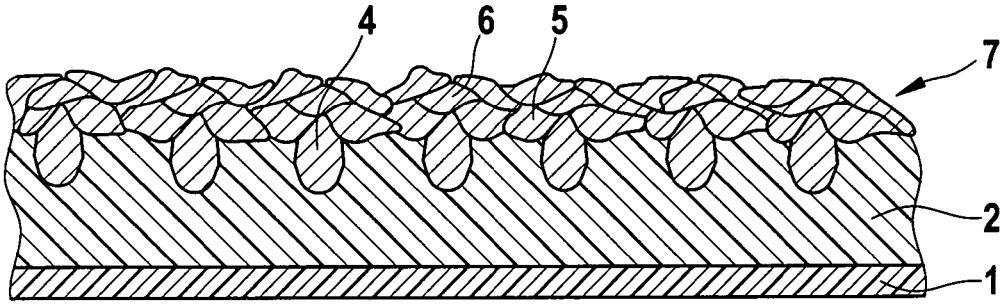
FIG. 3 shows a cross-sectional view of a protective layer applied to a resin film.

After application of this first sprayed layer, further sprayed layers are advantageously applied to the resin film. FIG. 3 shows the resin film 2 on the release film 1 with the embedded particles 4 of the first sprayed layer and further particles 5 and 6 of the second and third sprayed layers. As represented in FIG. 3, the applied particles of the various sprayed layers form a homogeneous protective layer 7 with very good adhesive attachment. The particles are positively anchored. It is obvious to a person skilled in the art that any number of sprayed layers is possible for forming the protective layer.

In a further method step, the release film is removed from the resin film. As a result, the bonding surface 9 of the resin film is exposed. The bonding surface 9 lies here on the side opposite from the protective layer 7. The exposed resin film is applied with the bonding surface 9 to a surface that has previously been roughened by means of very fine emery paper and cleaned, for example a surface of a structural component 8 of an aircraft, such as in particular a leading edge of carbon fiber reinforced plastic on a tail unit. After curing of the resin at 180° C., a coating with excellent adhesive attachment is obtained on the CRP component 8. It is obvious to a person skilled in the relevant art that the temperature necessary for the curing of the resin film must be made to match the nature of the resin. The skilled person therefore chooses a curing temperature that is appropriate for the resin. In the case of resins that are cured by means of irradiation, the skilled person also makes the kind of irradiation match the nature of the resin.

Figure 4:
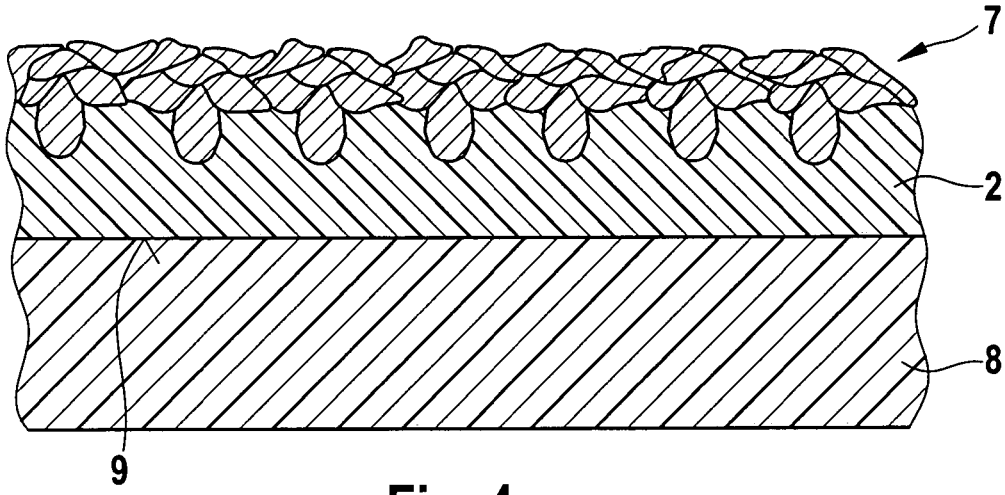
FIG. 4 shows a cross-sectional view of a resin film applied to a substrate and with a protective layer.

FIG. 4 shows a cross section through the CRP component 8 with a coating 7 applied to it, which is adhesively attached by way of the bonding surface 9 to the CRP component 8 by means of a resin film 2. This coating, for example on a leading edge of a tail unit of an aircraft, serves for lightning protection.

Although the present invention has been described here on the basis of preferred exemplary embodiments, it is not restricted to these but can be modified in various ways.

For example, the sprayed layer applied to the resin film may serve as an adherend surface for further layers. After application of the resin film with the applied coating to a substrate, it can be further coated by means of thermal spraying. The applied resin film and the coating applied on top of it serve in this case as an adherend surface and insulate the substrate lying thereunder. Therefore, strong heating of the substrate during the thermal spraying is prevented. Moreover, the excellent adhesive attachment of the resin film both to the applied coating and to the substrate allows a base to serve as an adherend surface for further layers that can otherwise only be applied with difficulty to the substrate. On account of the good insulating ability of the resin and the already applied protective layer, the further layers can be applied by means of thermal spraying without lengthy waiting times, that is to say without interim cooling down of the substrate. After the curing of the resin film, if need be the applied layer can be re-worked, for example by renewed roughening, before further coating, and/or can be re-worked by polishing after further coating. Re-working of the sprayed layer is also possible without any further subsequent coating.

If a protective layer is to be applied to a component with a curved surface, the resin film may be brought into the desired form before application of the protective layer. This can take place, for example, by placing the resin film, protected by means of a release film, onto a surface that has the same three-dimensional structure as the substrate to be coated. Since the resin film is protected by a release film, the resin film can be removed from the three-dimensional structure after the coating, and a coated resin film that is adapted in its three-dimensional structure to the surface structure of the component to be coated is obtained.

What is claimed is:

1. A method for coating a carbon fiber reinforced plastic component, the method comprising:

(a) providing a non-cured resin film, applied to a release film, the non-cured resin being at least one selected from the group consisting of thermoplastic resin, polyurethane resin, polyester resin or epoxy resin;

(b) applying at least one protective layer to a side of the non-cured resin film opposite the release film by a thermal spraying method, wherein an adhesive attachment of particles of the at least one protective layer is proportional to an energy that these particles possess and said particles penetrate into the non-cured resin film, so that after completion of the thermal spraying a material of the at least one protective layer achieves an effect of positive anchoring of the material on the non-cured resin film, and wherein the at least one protective layer being formed from at least one material selected from the group consisting of metals, metal alloys, plastics and ceramics, wherein said non-cured resin film is separated from said carbon fiber reinforced plastic component during application of said at least one protective layer;

(c) removing the release film from the non-cured resin film to expose a bonding surface of the resin film;

(d) applying the non-cured resin film having the at least one protective layer to the carbon fiber reinforced plastic component to be coated via the exposed bonding surface, wherein a final curing of the non-cured resin film is not completed before the non-cured resin film is applied to the carbon fiber reinforced plastic component; and (e) final curing of the non-cured resin film for the adhesive attachment of the completely cured resin film only after application to the carbon fiber reinforced plastic component, wherein the non-cured resin film is brought into a desired form before application of the protective layer, wherein the non-cured resin film protected by means of the release film is placed onto a surface that has a same three-dimensional structure as a structure of the carbon fiber reinforced plastic component.

2. The method according to claim 1, wherein the at least one protective layer is formed from a ceramic, selected from carbides and/or oxides.

3. The method according to claim 1, wherein the at least one protective layer comprises a metal selected from the group consisting of aluminium, zinc, nickel and copper.

4. The method according to claim 1, wherein the at least one protective layer comprises a metal alloy selected from the group consisting of alloys of the metals aluminium, zinc, nickel and/or copper.

5. The method according to claim 1, wherein the non-cured resin film is formed as a two-component epoxy resin.

6. The method according to claim 1, wherein the non-cured resin film is cured over a large area or partially by heating and/or irradiating the same.

7. The method according to claim 1, wherein a surface of the carbon fiber reinforced plastic component to which the non-cured resin film is applied is roughened and/or cleaned before application of the resin film.

8. The method according to claim 1, wherein the release film is formed as a polytetrafluoroethylene film.

9. The method according to claim 1, wherein the non-cured resin film is a polyurethane, polyester or epoxy resin film, and wherein, after the application of the at least one protective layer, the non-cured resin film is stored at a temperature of below 10° C., for a predetermined period of time.

10. The method according to claim 1, wherein after the application of the at least one protective layer, the non-cured resin film is stored at a temperature of below 0° C., for a predetermined period of time.

11. The method according to claim 1, wherein after the application of the at least one protective layer, the non-cured resin film is stored at a temperature of below −15° C., for a predetermined period of time.

12. The method according to claim 1, wherein the resin film is formed as a thermoplastic resin film, and wherein, after application of the at least one protective layer, the thermoplastic resin film is stored at room temperature for a predetermined period of time.

13. The method according to claim 1, wherein the particles of the at least one protective layer thereby penetrates partially into the non-cured resin film in a first method step of the thermal spraying method, in order subsequently to take the form of applied and partially embedded thermally sprayed particles, so that after the application of this first sprayed layer further thermally sprayed layers are applied to the non-cured resin film.

14. The method according to claim 1, wherein the resin film remains in a non-cured state before the resin film is applied to the carbon fiber reinforced plastic component and final curing of the resin film in a cured state is performed after the application to the carbon fiber reinforced plastic component.

15. The method according to claim 1, wherein a surface of the carbon fiber reinforced plastic component to which the non-cured resin film is applied is roughened before application of the non-cured resin film.

16. The method according to claim 1, wherein during the curing of the non-cured resin film, bonds are formed between a surface of the carbon fiber reinforced plastic component and the resin film and wherein the bonds are responsible for the adhesive strength of the cured resin film on the carbon fiber reinforced plastic component and for the adhesive attachment of the protective layer on the carbon fiber reinforced plastic component.

* * * * *